US007694820B2

(12) United States Patent
Liao et al.

(10) Patent No.: US 7,694,820 B2
(45) **Date of Patent: *Apr. 13, 2010**

(54) MULTI-SECTIONAL AIR ENCLOSURE AND CHECK VALVE APPARATUS

(75) Inventors: Chian Hua Liao, Sindian (TW); Yao Sin Liao, 4F., No. 7, Lane 130, Mincyuan Rd., Sindian City, Taipei County (TW); Yao Chuan Liao, Sindian (TW)

(73) Assignee: Yao Sin Liao, Taipei County (TW)

( * ) Notice: Subject to any disclaimer, the term of this patent is extended or adjusted under 35 U.S.C. 154(b) by 282 days.

This patent is subject to a terminal disclaimer.

(21) Appl. No.: 11/773,305

(22) Filed: Jul. 3, 2007

(65) Prior Publication Data

US 2008/0095474 A1 Apr. 24, 2008

(30) Foreign Application Priority Data

Oct. 20, 2006 (TW) ..... 95138751 A

(51) Int. Cl.
*B65D 30/22* (2006.01)

(52) U.S. Cl. ..... 206/522; 383/3; 383/44

(58) Field of Classification Search ..... 206/522; 383/3, 44, 37, 66; 137/233, 512.15, 846
See application file for complete search history.

(56) References Cited

U.S. PATENT DOCUMENTS

| | | | | |
|---|---|---|---|---|
| 4,850,912 | A * | 7/1989 | Koyanagi | 441/40 |
| 5,427,830 | A | 6/1995 | Pharo | |
| 6,629,777 | B2 | 10/2003 | Tanaka et al. | |
| 2005/0109411 | A1 * | 5/2005 | Koyanagi | 137/846 |
| 2005/0189257 | A1 * | 9/2005 | Chen et al. | 206/522 |

FOREIGN PATENT DOCUMENTS

| | | | |
|---|---|---|---|
| DE | 3922802 | A1 | 1/1991 |
| DE | 202004006032 | U1 | 9/2004 |
| JP | 05016671 | U | 3/1993 |
| JP | 05-095851 | | 12/1993 |
| JP | 08-034478 | | 2/1996 |
| JP | 3356962 | B2 | 10/2002 |
| JP | 2003072851 | A | 3/2003 |
| JP | 17-162268 | | 6/2005 |
| JP | 2005193954 | A | 7/2005 |
| KR | 0390052 | | 7/2005 |
| WO | 90/09320 | A2 | 8/1990 |

* cited by examiner

*Primary Examiner*—J. Gregory Pickett
*Assistant Examiner*—King M Chu
(74) *Attorney, Agent, or Firm*—Rabin & Berdo, P.C.

(57) ABSTRACT

In a multi-sectional air enclosure, an air filling passageway is formed between two outer films folded together and in the meantime, a plurality of air cylinders are formed by adhering the two outer films to each other by means of hot sealing, each air cylinder is adhered to form into a plurality of air chambers in series by means of hot sealing. Furthermore, air inlets are formed between the inner film and the outer film to communicate the air filling passageway with the air cylinders, and a plurality of air passageways are formed to connect to the air inlets. Besides, each air passageway is connected to a plurality of branch air passageways, and an opening is disposed at the end of each branch air passageway.

20 Claims, 13 Drawing Sheets

MULTI-SECTIONAL AIR ENCLOSURE AND CHECK VALVE APPARATUS

CROSS-REFERENCES TO RELATED APPLICATIONS

This non-provisional application claims priority under 35 U.S.C. §119(a) on Patent Application No(s). 095138751 filed in Taiwan, R.O.C. on 2006, Oct. 20, the entire contents of which are hereby incorporated by reference.

FIELD OF INVENTION

The present invention relates to an air enclosure and air lock valve apparatus, and more particularly to a multi-sectional air enclosure and a check valve apparatus.

BACKGROUND

A conventional cushioning manner used on a packed article always uses a plastic sheet with a plurality of small projecting air bag disposed thereon to cover the surroundings of the article to attain to the shock absorption and the cushioning functions. But, shock absorption ability of the small air bags is limited; they cannot absorb larger shock or impulse such that the shock absorption and the buffering effects cannot be reached. Therefore, an air packing bag manufactured from a resin film material is developed.

Please refer to FIGS. 1A to 1C. A plurality of air inlets A11 are disposed on an air packing bag A10, an air passageway A12 is connected to each air inlet A11 and a plurality of air chambers A13 are respectively connected to two sides of the air passageway A13. An air valve constituted by a upper air valve film A141 and a lower air valve film A142 is disposed on each air chamber A13. Whereby, the air packing bag A10 can be filled with air to bulge and taken as a cushioning material after outside air flows through the air inlet A11, the air passageway A12 and into the air chamber A1, for example, The U.S. Pat. No. 4,850,912 entitled as "Container for sealingly containing a fluid", The U.S. Pat. No. 5,261,466 entitled as "Process for continuously filling fluid into a plurality of closed bags", The U.S. Pat. No. 5,427,830 entitled as "Continuous, inflatable plastic wrapping material". However, not only the plurality of air passageway A12 are needed to dispose on such kind of air packing bag A10, and then the plurality of air chamber sets can be filled with air, but also the plurality of independent air chambers A13 cannot share the same air valve A14 to be filled with air.

Please refer to FIG. 1D. A plurality of nodes A15 are disposed on the air chamber A13 of the air packing bag A10, thereby the air chamber A 13 is bended to form a plurality of minor air chambers, thereby an article is packed and the cushioning protection is provided, for example, U.S. Pat. No. 6,629,777 entitled as "Buffer packing bag". However, if any minor air chamber of such kind of air packing bag A10 is broken, the air in the whole air chamber A13 is then leaked out such that sectional independent minor air chambers cannot be established in a single air chamber A13 after it is filled with air.

Please refer to FIGS. 2A to 2C. FIGS. 2A to 2C show a U.S. Pat. No. 5,427,830 entitle as "Continuous inflatable plastic wrapping material". The air passageway A12 of the air packing bag A10 is formed by an upper air valve film A141 and a lower air valve film A142 by means of hot sealing, and the air passageway A12 is attached closely on an outer film A161 and passed through the plurality of air chambers A13. However, the air chambers A13 can merely be disposed side by side levelly in such kind of air packing bag A10 and can then be filled with air through one air passageway A12; if the air chambers A13 are to be disposed in series vertically, they must be filled with air section by section. Moreover, the air chamber A13 is partitioned into a plurality of minor air chambers through hot sealing lines A17. But, if any minor air chamber is broken, the air in the whole air chamber A13 is then leaked out such that sectional independent minor air chambers cannot be established in a single air chamber A13 after it is filled with air.

Please refer to FIGS. 3A and 3B. The air packing bag is an air enclosure constituted by two soft resin made outer films A161 and A162 together with the inner portion thereof can be filled with air. Furthermore, an air valve A14 is assembled between the two outer films A161 and A162, and an air passageway is formed by partly adhering the upper air valve film A141 and the lower air valve film 142 to each other after the air valve A14 folds the upper air valve film A141 and the lower air valve film A142 opposite to each other together. However, the air valve 14 of such kind of air packing bag A10 cannot fill the plurality of air chambers A13 with air simultaneously, and the air chambers A13 can merely be disposed side by side levelly and can then be filled with air through one air passageway A12; if the air chambers A13 are to be disposed in series vertically, they must be filled with air section by section.

Therefore, for improving the structures of the air packing bag to allow a plurality of air chambers disposed in series vertically to be filled with air simultaneously and preventing the air in the whole air chamber from being leaked out once any minor air chamber is broken, the present invention is proposed.

SUMMARY

For improving the deficits mentioned above, the present invention proposes a multi-sectional air enclosure; it comprises two outer films, an inner film, an air filling passageway, a plurality of air cylinders, at least one air inlet, a plurality of air passageways, a plurality of branch air passageways and a plurality of openings. The two outer films folded to each other vertically, the inner film is disposed between the two outer films. The air filling passageway is positioned between the two outer films and used for allowing outside air to be filled in; the plurality of air cylinders are disposed side by side beside the air filling passageway and adhered to form between the two outer films by means of hot sealing, each air cylinder is adhered to form into a plurality of air chambers in series by mean of hot sealing; the air inlet is formed between the inner film and one of the outer films and used for communicating the air filling passageway with the air cylinder; the plurality of air passageways are connected to the air inlets and formed between the inner film and one of the outer films and the plurality of openings is positioned on the inner film, each opening is positioned at the end of each branch air passageway.

The present invention also proposes a multi-sectional air enclosure; it comprises two outer films, two inner films, an air filling passageway, a plurality of air cylinders, at least one air inlet, a plurality of air passageways, a plurality of branch air passageways and a plurality of openings. The two outer films folded to each other vertically, the inner film is disposed between the two outer films; the air filling passageway is positioned between the two outer films and used for allowing outside air to be filled in; the plurality of air cylinders are disposed side by side beside the air filling passageway and adhered to form between the two outer films by means of hot sealing, each air cylinder is adhered to form into a plurality of air chambers in series by mean of hot sealing; the air inlet is formed between the two inner films and used for communicating the air filling passageway with the air cylinder; the plurality of air passageways are connected to the air inlets and formed between the inner films and the plurality of openings is positioned on the inner film, each opening is positioned at the end of each branch air passageway.

When the air in the air filling passageway flows into the plurality of branch air passageways through the air passageway and is filled in to each air chamber to cause it to be filled with air and expanded through each opening. Furthermore, the air in each air chamber compresses the air passageway to form the air locking after being filled with air and expanded; it allows the shock absorption cushioning ability to be maintained under the condition that the air in other air chambers not to be leaked out once any one of the air chambers is broken.

The present invention proposes a check valve apparatus of a multi-sectional air enclosure assembled in a plurality of air cylinders formed by adhering two outer films to each other by means of hot sealing, and each air cylinder is formed into a plurality of air chambers in series by means of hot sealing. The check valve apparatus comprises an inner film, an air passageway, a plurality of branch air passageways and a plurality of openings. The inner film is disposed between two outer films; the air passageway is formed between the inner film and one of the outer films; the plurality of branch air passageways are communicated with the air passageway and formed between the inner film and one of the outer films and the plurality of openings is positioned on the inner film, each opening is positioned at the end of each branch air passageway.

The present invention also proposes a check valve apparatus of a multi-sectional air enclosure assembled in a plurality of air cylinders formed by adhering two outer films to each other by means of hot sealing, and each air cylinder is formed into a plurality of air chambers in series by means of hot sealing. The check valve apparatus comprises two inner films, an air passageway, a plurality of branch air passageways and a plurality of openings. The inner film is disposed between two outer films; the air passageway is formed between the two inner films; the plurality of branch air passageways are communicated with the air passageway and formed between the two inner films and the plurality of openings is positioned on the inner film, each opening is positioned at the end of each branch air passageway.

When outside air flows into the plurality of branch air passageways through the air passageway and is filled in to each air chamber to cause it to be filled with air and expanded through each opening. Furthermore, the air in each air chamber compresses the air passageway to form the air locking after being filled with and expanded; it allows the shock absorption cushioning ability to be maintained under the condition that the air in other air chambers not to be leaked out once any one of the air chambers is broken.

BRIEF DESCRIPTION OF THE DRAWINGS

The present invention can be more fully understood by reference to the following description and accompanying drawings, in which.

DETAILED DESCRIPTION

Figure 1A:
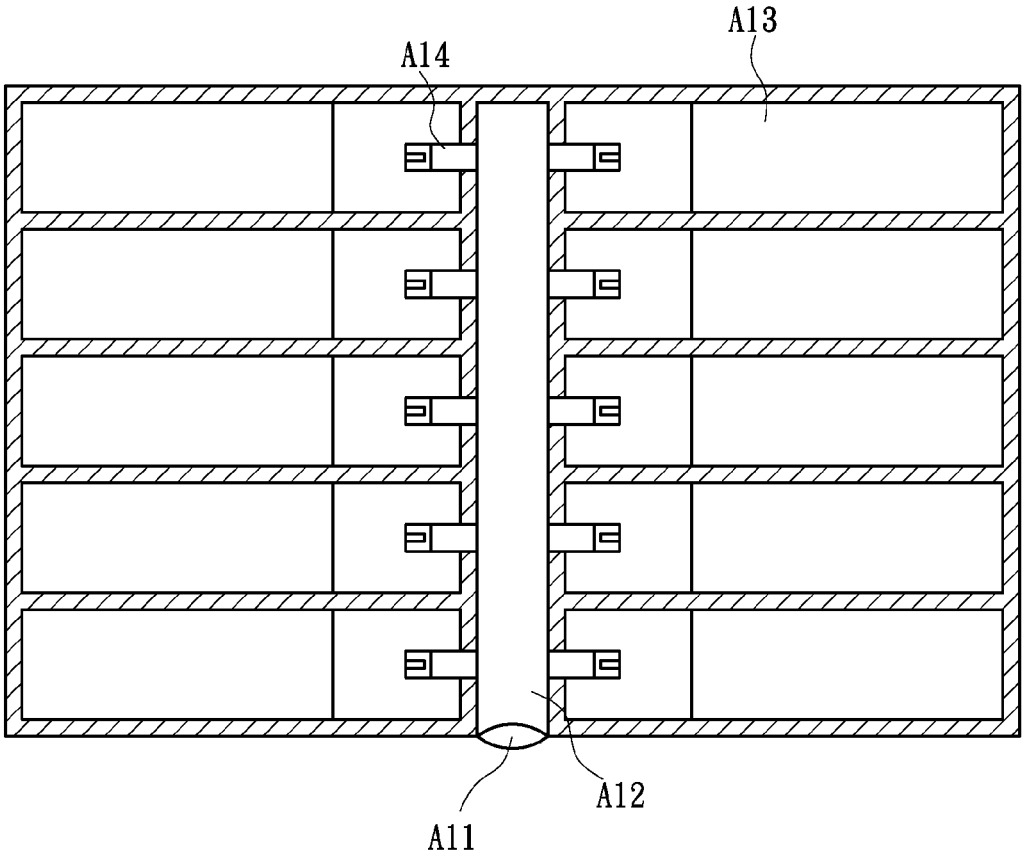
FIG. 1A is a schematic view of a conventional air packing bag before being filled with air.
Figure 1B:
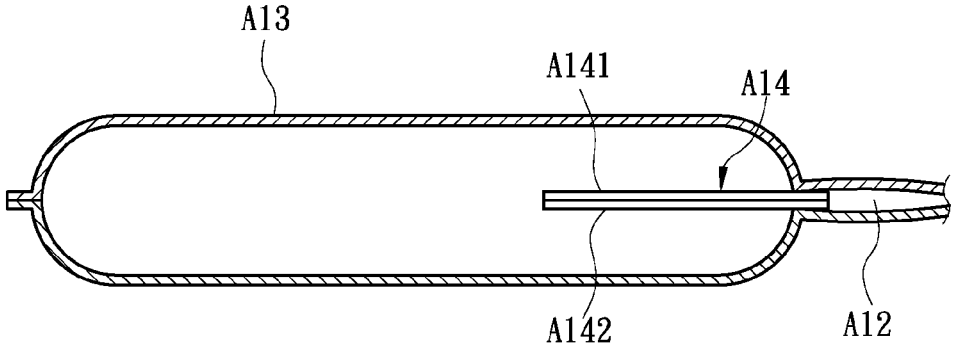
FIG. 1B is a cross sectional view of a conventional air packing bag after being filled with air.
Figure 1C:
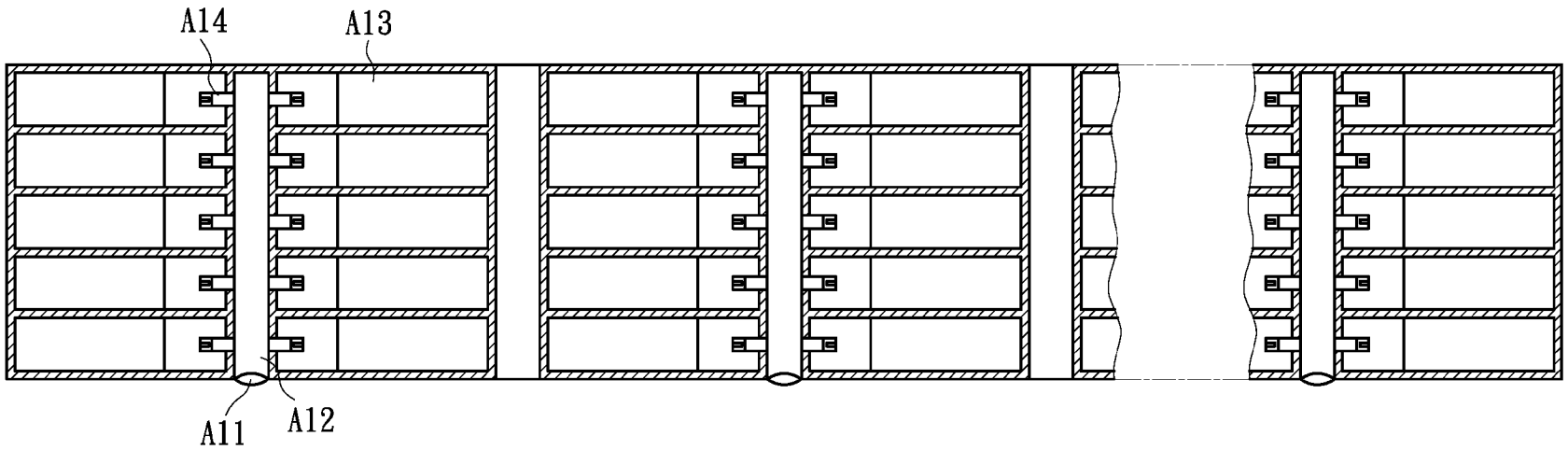
FIG. 1C is a schematic view of a conventional air packing bag before being filled with air.
Figure 1D:
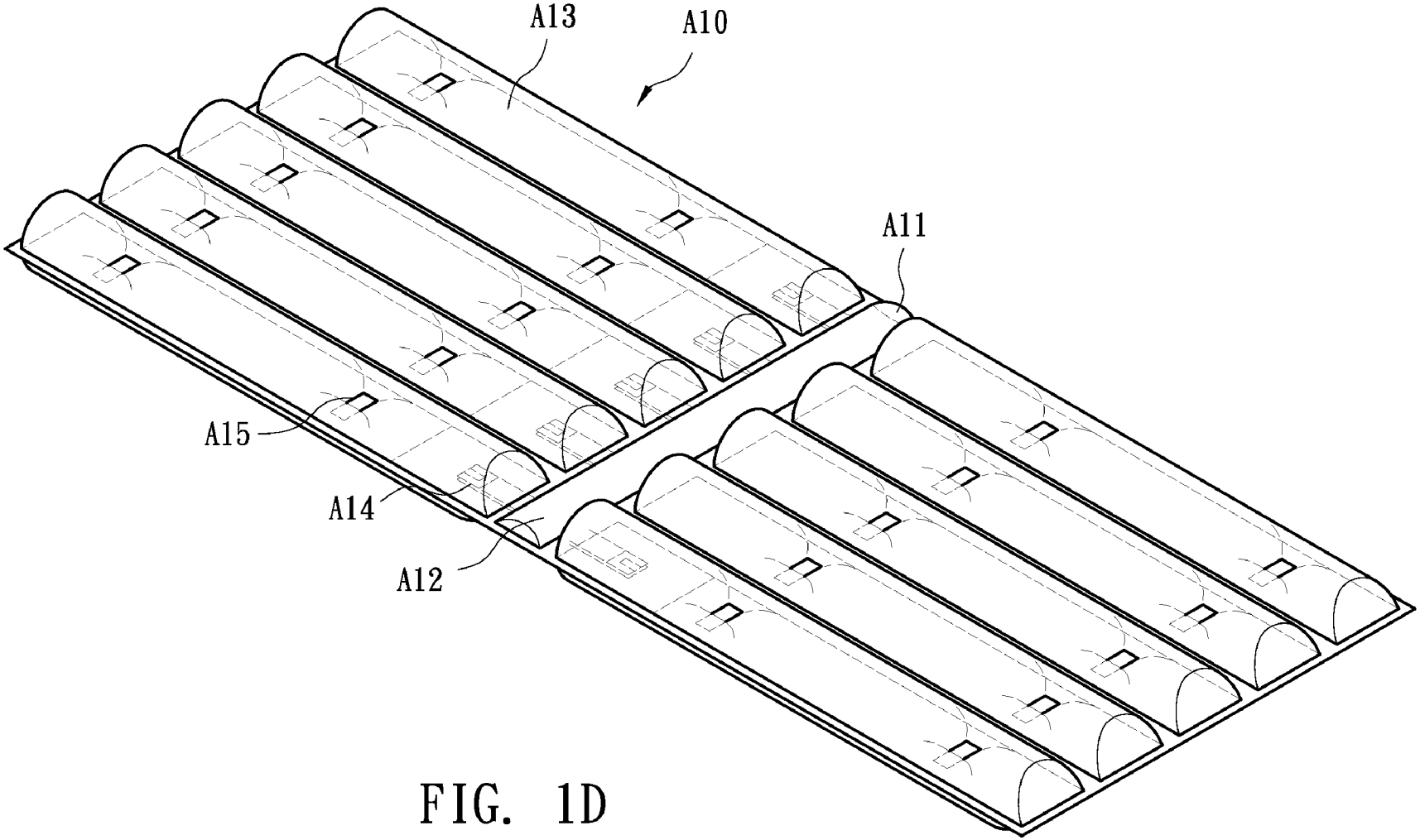
FIG. 1D is a schematic view of a conventional air packing bag after being filled with air.
Figure 2B:
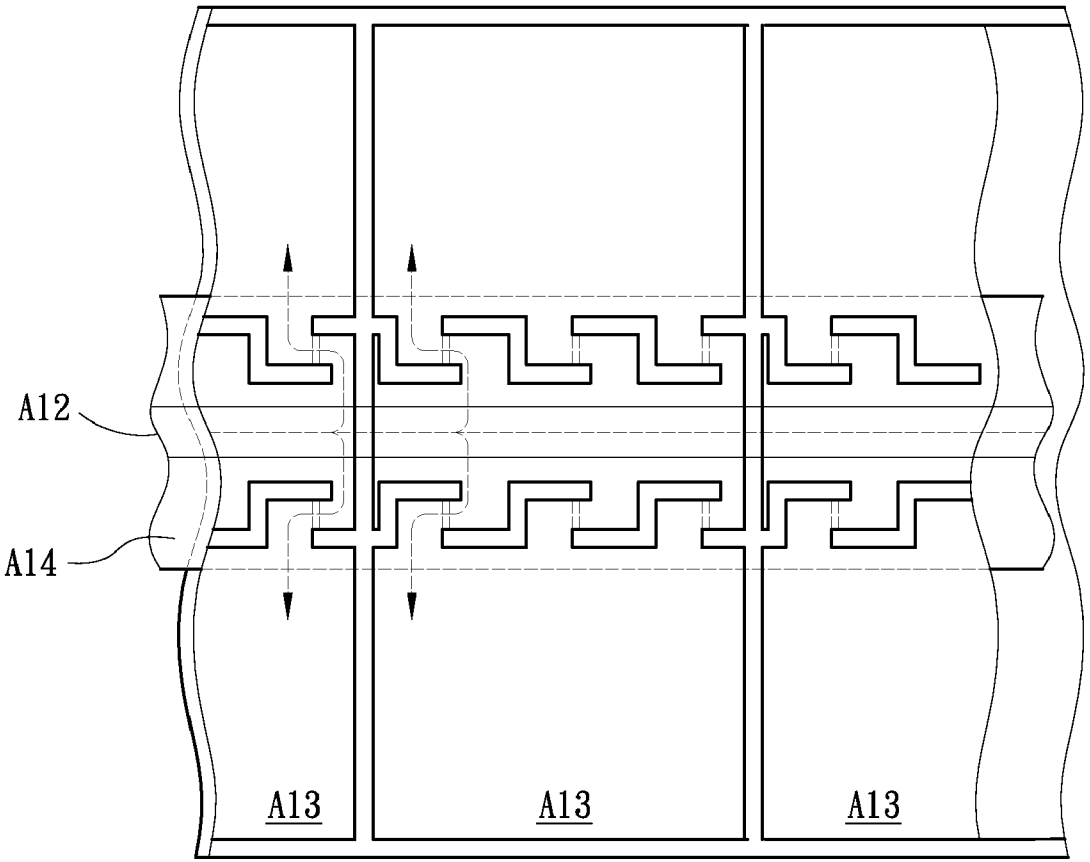
FIG. 2B is a schematic view of a conventional air packing bag before being filled with air.
Figure 2A:
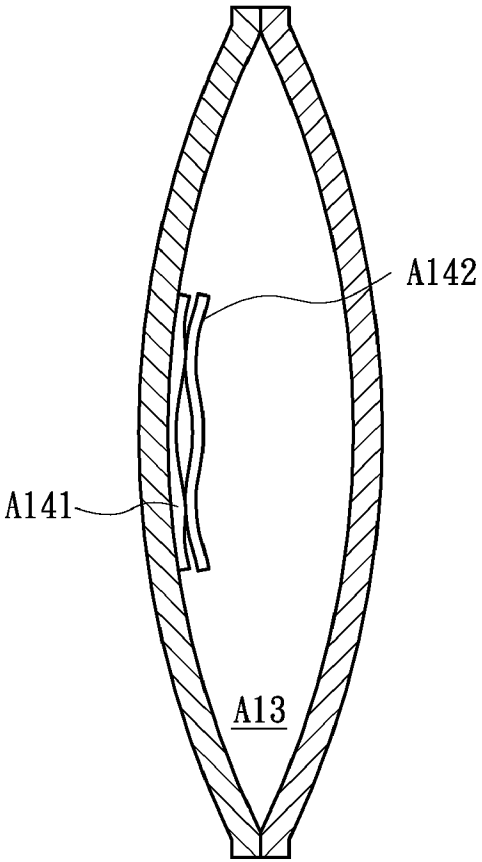
FIG. 2A is a cross sectional view of a conventional air packing bag after being filled with air.
Figure 2C:
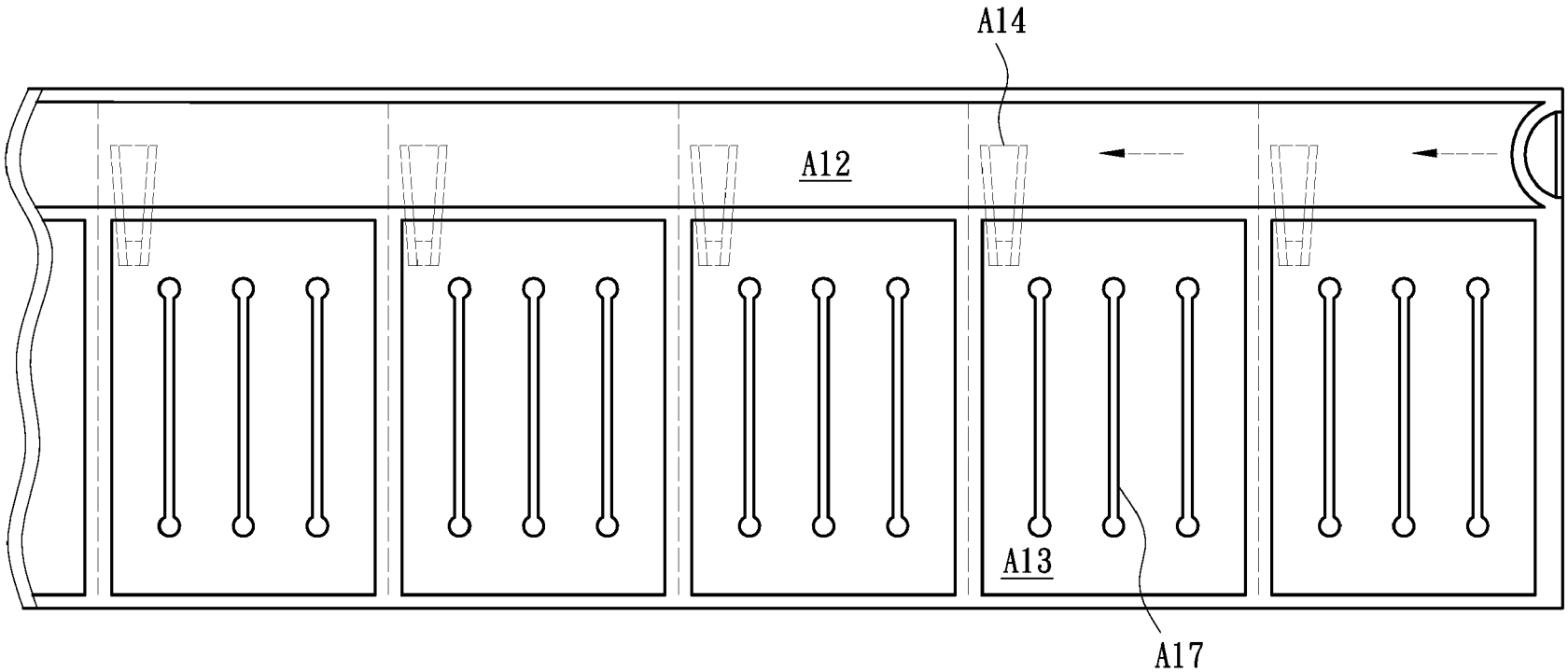
FIG. 2C is a schematic view of a conventional air packing bag before being filled with air.
Figure 3A:
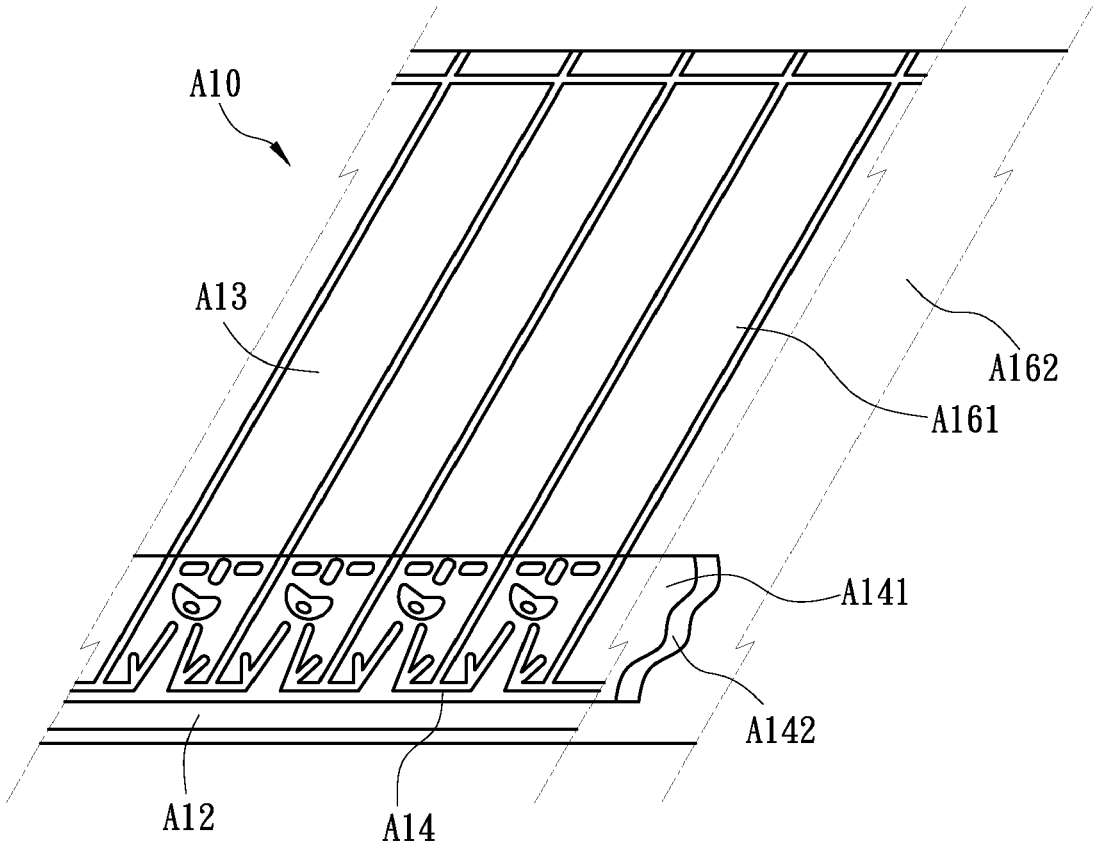
FIG. 3A is a schematic view, showing an air valve structure of a conventional air packing bag.
Figure 3B:
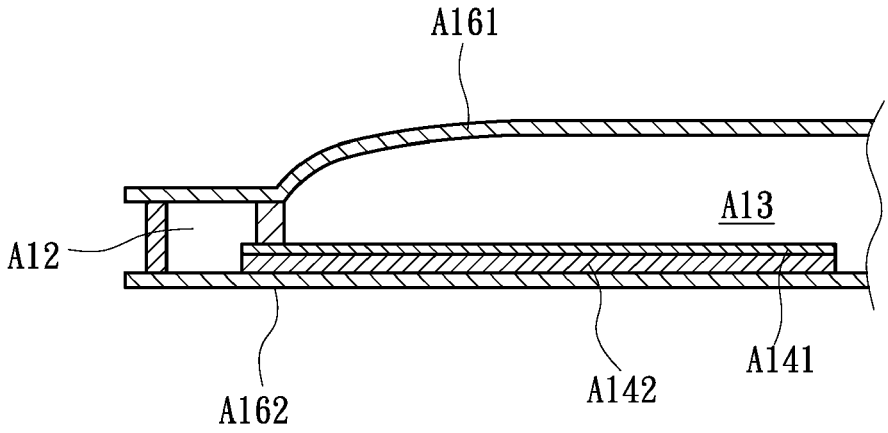
FIG. 3B is a cross sectional view, showing an air valve structure of a conventional air packing bag.
Figure 4:
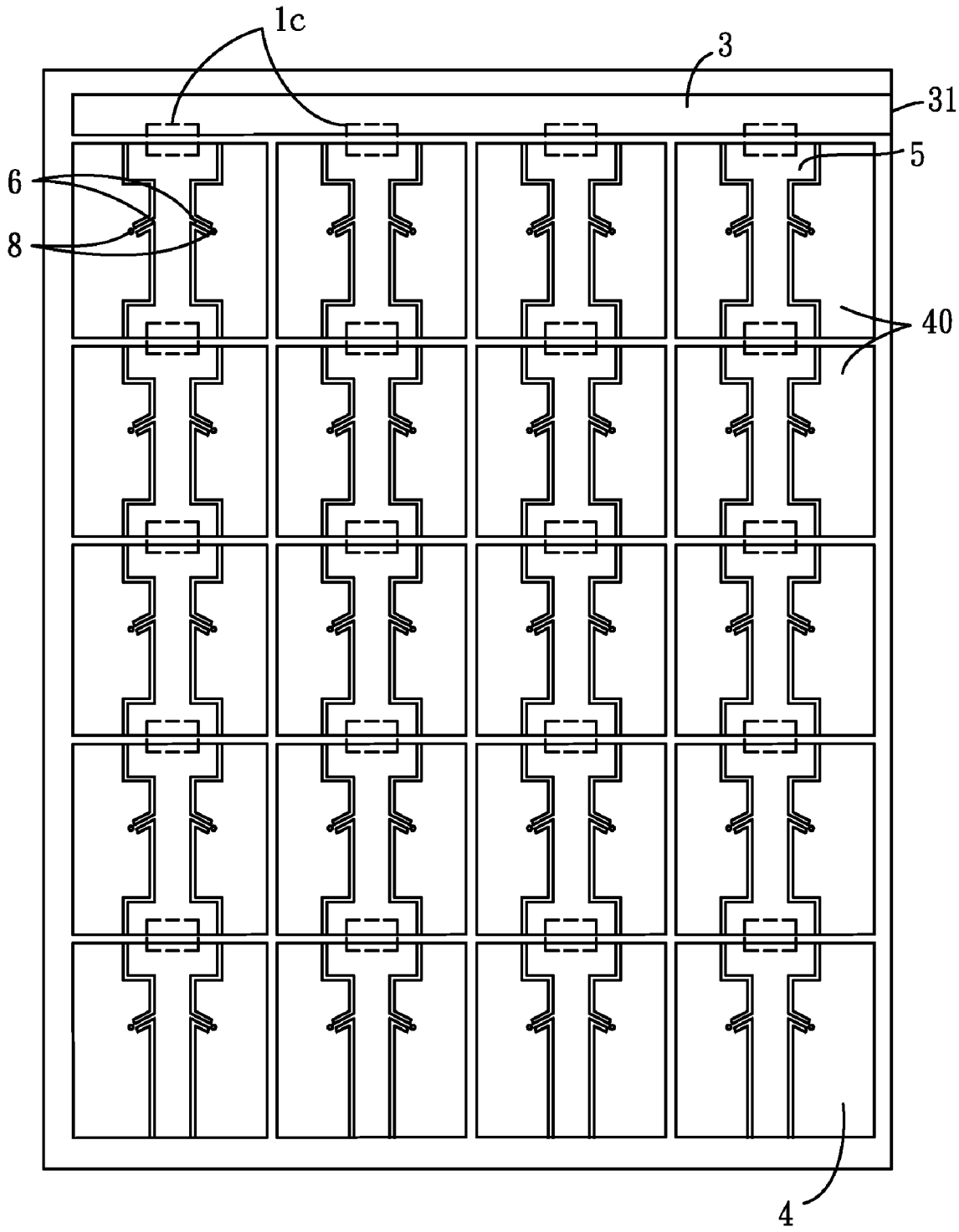
FIG. 4 is a plane view, showing a one-sheet-wall-attached type multi-sectional air enclosure before air filling according to the present invention.
Figure 5:
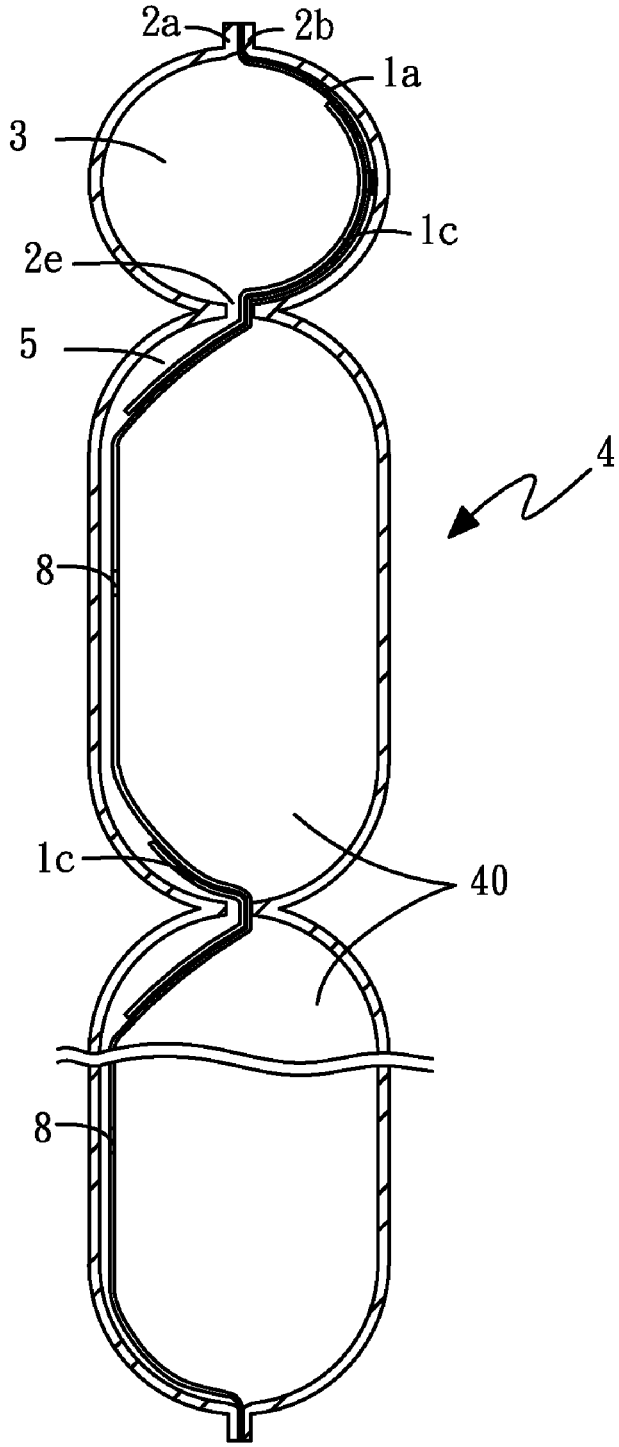
FIG. 5 is a cross sectional view, showing a one-sheet-wall-attached type multi-sectional air enclosure after air filling according to the present invention.

Please refer to FIGS. 4 and 5. FIG. 4 is a plane view, showing a one-sheet-wall-attached type multi-sectional air enclosure before air filling according to the present invention. FIG. 5 is a cross sectional view, showing a one-sheet-wall-attached type multi-sectional air enclosure after air filling according to the present invention.

A multi-sectional air enclosure comprises air filling passageway 3, air cylinder 4, air inlet 2*e*, air passageway 5, branch air passageway 6 and opening 8.

The air filling passageway 3 is a space formed by adhering an inner film 1*a* to an outer film 2*a* or 2*b* by means of hot sealing, and can also be a space formed by adhering the two outer films 2*a* and 2*b* to each other by means of hot sealing. Furthermore, the air filling passageway 3 comprises an air filling entrance 31 used for allowing outside air to be filled in.

The plurality of air cylinders 4 are air storable spaces formed by adhering the two outer films 2*a* and 2*b* to each other by means of hot sealing and disposed side by side beside the air filling passageway. Furthermore, each air cylinder 4 is adhered to form into a plurality of air chambers 40 in series by means of hot sealing.

The plurality of air inlets 2*e* are formed between the inner film 1*a* and the outer film 2*a* or 2*b* and used for communicating the air filling passageway 3 with the air cylinders 4 by not adhering the inner film 1*a* to the outer film 2*a* or 2*b* by means of hot sealing even after a heat resistant material is spread on one surface of the inner film 1*a*.

The plurality of air passageways 5 respectively connected to each air inlet 2*e* are formed between the inner film 1*a* and the outer film 2*a* or 2*b* by not adhering the inner film 1*a* to the outer film 2*a* or 2*b* by means of hot sealing even after a heat resistant material 1*c* is spread on one surface of the inner film 1*a*.

The plurality of branch air passageways 6 communicate with the air passageways 5 and are formed between the inner film 1 and the outer film 2*a* or 2*b* by not adhering the inner film 1*a* to the outer film 2*a* or 2*b* by means of hot sealing even after a heat resistant material 1*c* is spread on one surface of the inner film 1*a*.

The plurality of openings 8 are positioned on the inner film 1*a*, each opening 8 is positioned at the end of each branch air passageway 6.

According to the structure disclosed by the present invention, the heat resistant material 1*c* is equidistantly spread on one surface of the inner film 1*a*, and the vertical spacing of the heat resistant material 1*c* is the length of the air chamber 40 and the lateral spacing of the heat resistant material 1*c* is the width of the air chamber 40.

When air filling is processed, outside air entering the air filling entrance 11 expands the air filling passageway 3 to cause the inner film 1*a* and the outer film 2*a* or 2*b* to be pulled apart outward to open the air inlet 2*e* (according to the difference of the structure of the air filling passageway 3, the two outer films 2*a* and 2*b* can also be caused to pull apart outward to open the air inlet 2*e*) to allow the air to enter the air passageway 5, and one part of the air flows to the branch air passageways 6 and then into the air chamber 40 to cause it to be filled with air and expanded through the openings 8 at the ends of the branch air passageways 6, another part of the air flows into other branch air passageways 6 along the air passageways 5, and enters the different air chambers 40 to allow them to be filled with air and expanded through the opening 8 at the end of each branch air passageway 6.

After each chamber 40 is filled with air and expanded, the internal air pressure of each air chamber 40 compresses the inner film 1*a* to attach closely onto the outer film 2*a* or 2*b* to cover the air passageway 5 to shield each air chamber 40 to enable the air in the air chamber 40 not to be leaked out to attain to the air locking effect. Therefore, when any air chamber 40 is broken, the structure disclosed by the present invention can prevent the air in other air chambers 40 from being leaked out and further maintain the shock absorption cushioning ability.

Furthermore, because the air pressure of each air chamber can reach the same, it doesn't cause the air chambers 40 positioned behind not to be able to be filled with air because the air pressure of the air chambers 40 close to the air filling passageway 3 first covers the air passageway 5 when the air is filled. Therefore, the structure disclosed by the present invention allows each air chamber to be filled with air simultaneously; it not only elevates the air filling speed but also further lowers the production cost.

The air filling passageway 3 mentioned above can be connected to one air inlet 2*e* or the plurality of air inlets 2*e*. Each air chamber 40 can be connected to one air passageway 5 or the plurality of air passageways 5, and each air chamber 40 can communicate with each other and further share one air passageway 5 or the plurality of air passageways 5. Furthermore, the dimension of the two outer films 2*a* and 2*b* can be the same as the inner film 1*a*, or the length of the inner film 1*a* is shorter than the two outer films 2*a* and 2*b*, and the upper side of the inner film 1*a* can be lined up with the upper sides of the two outer film 2*a* and 2*b*. Furthermore, when the length of the inner film 1*a* is shorter than the two outer films 2*a* and 2*b*, one end of the air filling passageway 3 far away from the inner film can first be adhered to the outer film 2*a* or 2*b* by means of hot sealing.

Figure 6:
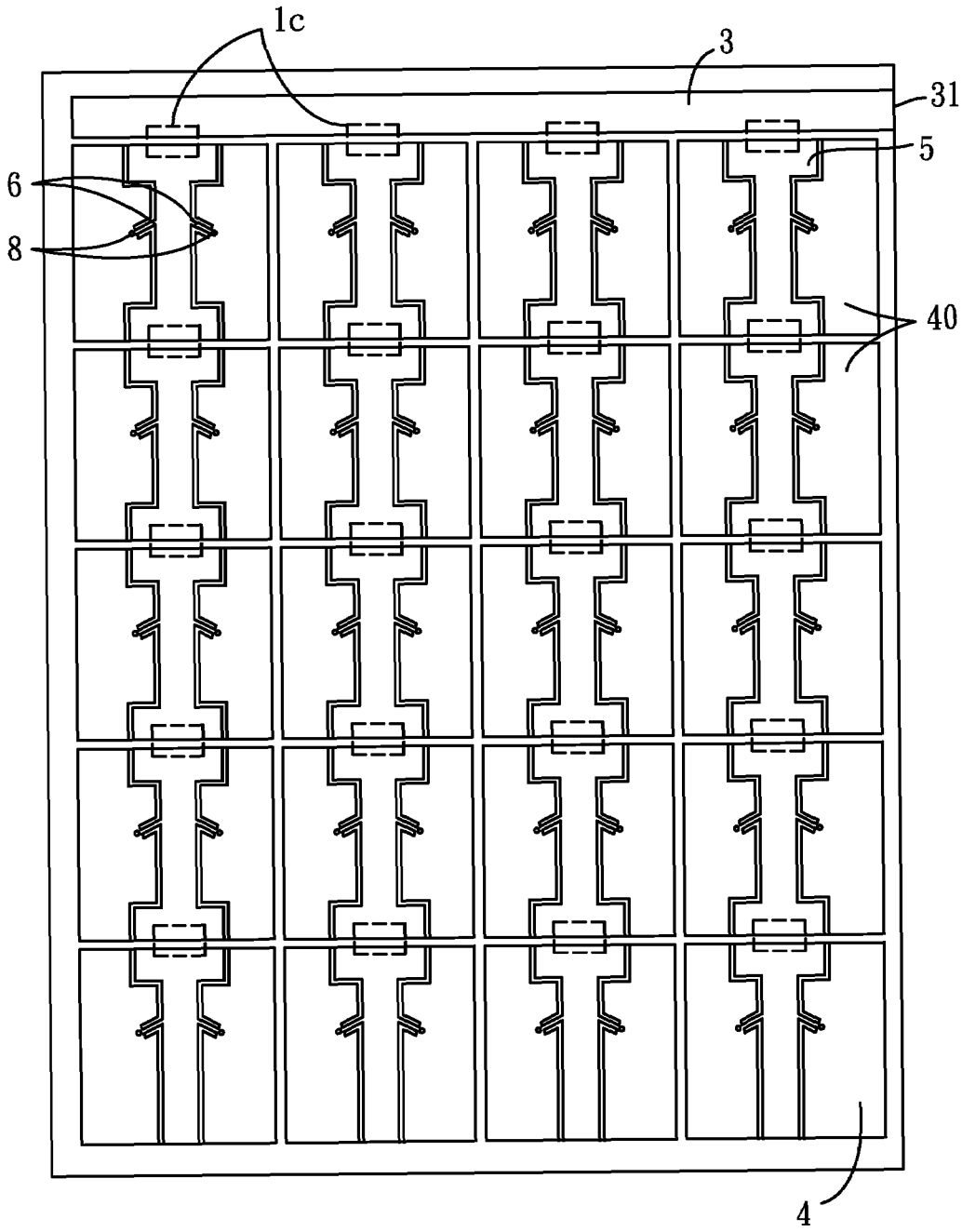
FIG. 6 is a plane view, showing a two-sheets-wall-attached type multi-sectional air enclosure before air filling according to the present invention.
Figure 7:
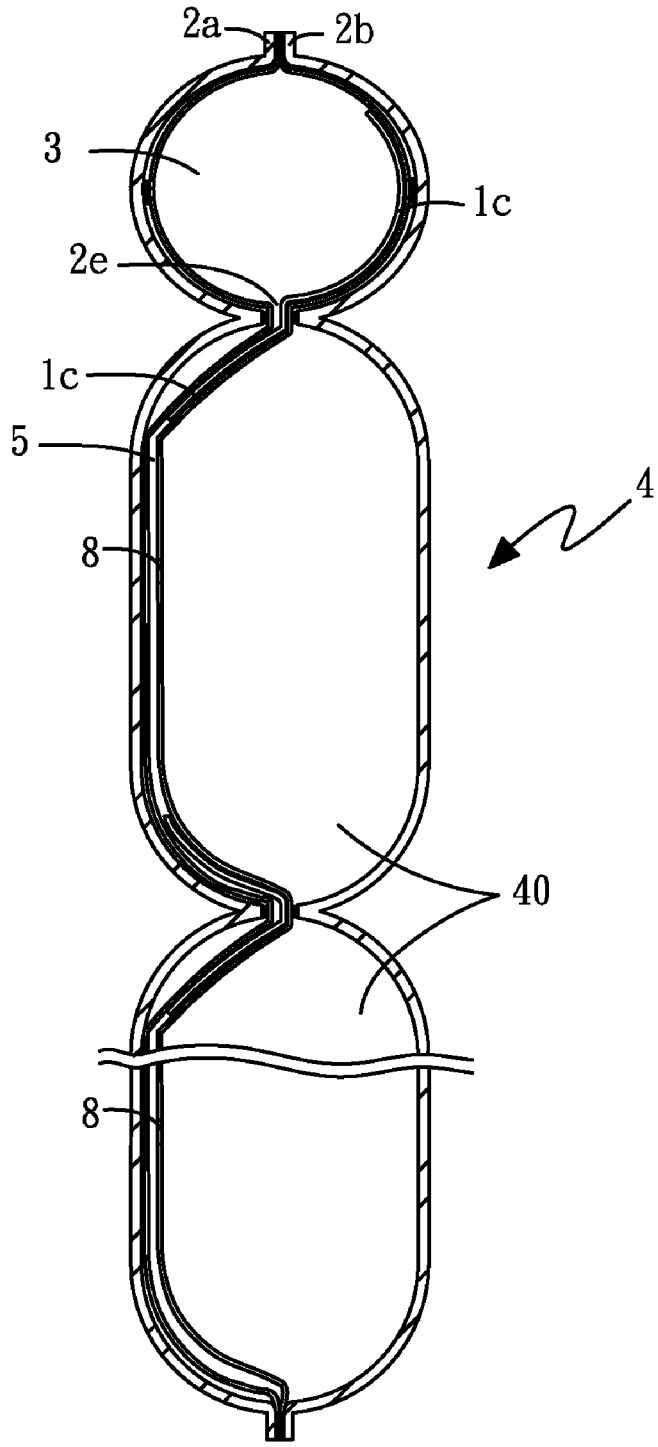
FIG. 7 is a cross sectional view, showing a two-sheets-wall-attached type multi-sectional air enclosure after air filling according to the present invention.

Please refer to FIGS. 6 and 7. FIG. 6 is a plane view, showing a two-sheets-wall-attached type multi-sectional air enclosure before air filling according to the present invention. FIG. 7 is a cross sectional view, showing a two-sheets-wall-attached type multi-sectional air enclosure after air filling according to the present invention.

A multi-sectional air enclosure comprises air filling passageway 3, air cylinder 4, air inlet 2*e*, air passageway 5, branch air passageway 6 and opening 8.

The air filling passageway 3 is a space formed by adhering the two outer films 2*a* and 2*b* to each other by means of hot sealing, can also be a space formed by adhering two inner films 1*a* and 1*b* to each other by means of hot sealing and can also be a space formed by adhering the inner film 1*a* or 1*b* to the outer film 2*a* or 2*b* by means of hot sealing. Furthermore, the air filling passageway 3 comprises an air filling entrance 31 used for allowing outside air to be filled in.

The plurality of air cylinders 4 are air storable spaces formed by adhering the two outer films 2*a* and 2*b* to each other by means of hot sealing and disposed side by side beside the air filling passageway. Furthermore, each air cylinder 4 is adhered to form into a plurality of air chambers 40 in series by means of hot sealing.

The plurality of air inlets 2*e* are formed between the two inner films 1*a* and 1*b* and used for communicating the air filling passageway 3 and the air cylinders 4 by adhering the inner films 1*a* and 1*b* to each other by means of hot sealing even after a heat resistant material is spread between the inner films 1*a* and 1*b*.

The plurality of air passageways 5 respectively connected to each air inlet 2*e* are formed between the two inner films 1*a* and 1*b* by not adhering the two inner films 1*a* and 1*b* to each other by means of hot sealing even after a heat resistant material 1*c* is spread between the two inner films 1*a* and 1*b*.

The plurality of branch air passageways 6 communicate with the air passageway 5, and are formed between the two inner films 1*a* and 1*b* by not adhering the two inner film 1*a* and 1*b* to each other by means of hot sealing even after a heat resistant material 1*c* is spread between the two inner films 1*a* and 1*b*.

The plurality of openings 8 are positioned on the inner film 1*a* or 1*b* and can also be positioned on the two inner films 1*a* and 1*b* simultaneously, each opening 8 is positioned at the end of each branch air passageway 6.

According to the structure disclosed by the present invention, the heat resistant material 1*c* is equidistantly spread between the two inner films 1*a* and 1*b*, and the vertical spacing of the heat resistant material 1*c* is the length of the air chamber 40 and the lateral spacing of the heat resistant material 1*c* is the width of the air chamber 40.

When the air filling is processed, outside air entering the air filling entrance 11 expands the air filling passageway 3 to cause the two outer films 2*a* and 2*b* to be pulled apart outward to open the air inlet 2*e* (according to the difference of the structure of the air filling passageway 3, the two inner films 1*a* and 1*b* or the inner films 1*a* or 1*b* and the outer film 2*a* or 2*b* can also be caused to pull apart outward to open the air inlet 2*e*) to allow the air to enter the air passageway 5, and one part of the air flows to the branch air passageways 6 and flows into the air chamber 40 to cause it to be filled with air and expanded through the openings 8 at the ends of the branch air passageways 6, Another part of the air flows into other branch air passageways 6 along the air passageways 5, and enters the different air chambers 40 to allow them to be filled with air and expanded through the opening 8 at the end of each branch air passageway 6.

After each chamber 40 is filled with air and expanded, the internal air pressure of each air chamber 40 compresses the two inner films 1*a* and 1*b* to attach closely onto the outer film 2*a* or 2*b* to cover the air passageway 5 to shield each air chamber 40 to enable the air in the air chamber 40 not to be leaked out to attain to the air locking effect. Therefore, when any air chamber 40 is broken, the structure disclosed by the present invention can prevent the air in other air chambers 40 from being leaked out and further maintain the shock absorption cushioning ability.

Figure 8:
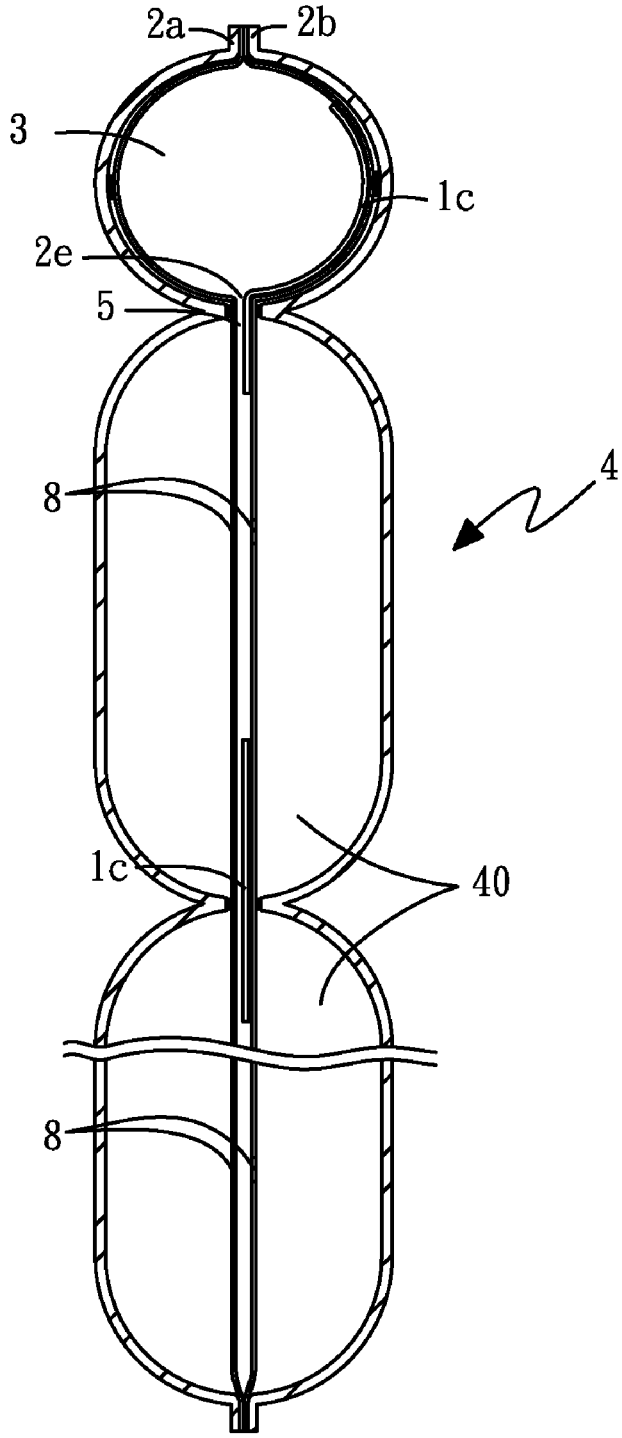
FIG. 8 is a cross sectional view, showing a two-sheets-cantilever type multi-sectional air enclosure after air filling according to the present invention.

Please refer to FIG. 8. FIG. 8 is a cross sectional view, showing a two-sheets-cantilever type multi-sectional air enclosure after air filling according to the present invention.

After each air chamber 40 is filled with air and expanded, the internal air pressure of each air chamber 40 compresses the two inner films 1*a* and 1*b* not to side-attach onto the outer film 2*a* or 2*b* to form a two-sheets-cantilever type multi-sectional air enclosure; other structure characteristics almost are the same as the two-sheets-wall-attached type multi-sectional air enclosure except the two inner films 1*a* and 1*b* are not side-attached onto the outer film 2*a* or 2*b*.

The air filling passageway 3 mentioned above can be connected to one air inlet 2*e* or the plurality of air inlets 2*e*. Each air chamber 40 can be connected to one air passageway 5 or the plurality of air passageways 5, and each air chamber 40 can be communicated with each other and further share one air passageway 5 or the plurality of air passageways 5. Furthermore, the dimension of the two outer films 2*a* and 2*b* can be the same as the two inner films 1*a* and 1*b*, or the length of the two inner film 1*a* and 1*b* is shorter than the two outer films 2*a* and 2*b*, and the upper sides of the two inner film 1*a* and 1*b* can be lined up with the upper sides of the two outer film 2*a* and 2*b*. Furthermore, when the length of the two inner films 1*a* an 1*b* is shorter than the two outer films 2*a* and 2*b*, one end of the air filling passageway 3 far away from the inner film can first be adhered to form a shielding shape by means of hot sealing.

Figure 9A:
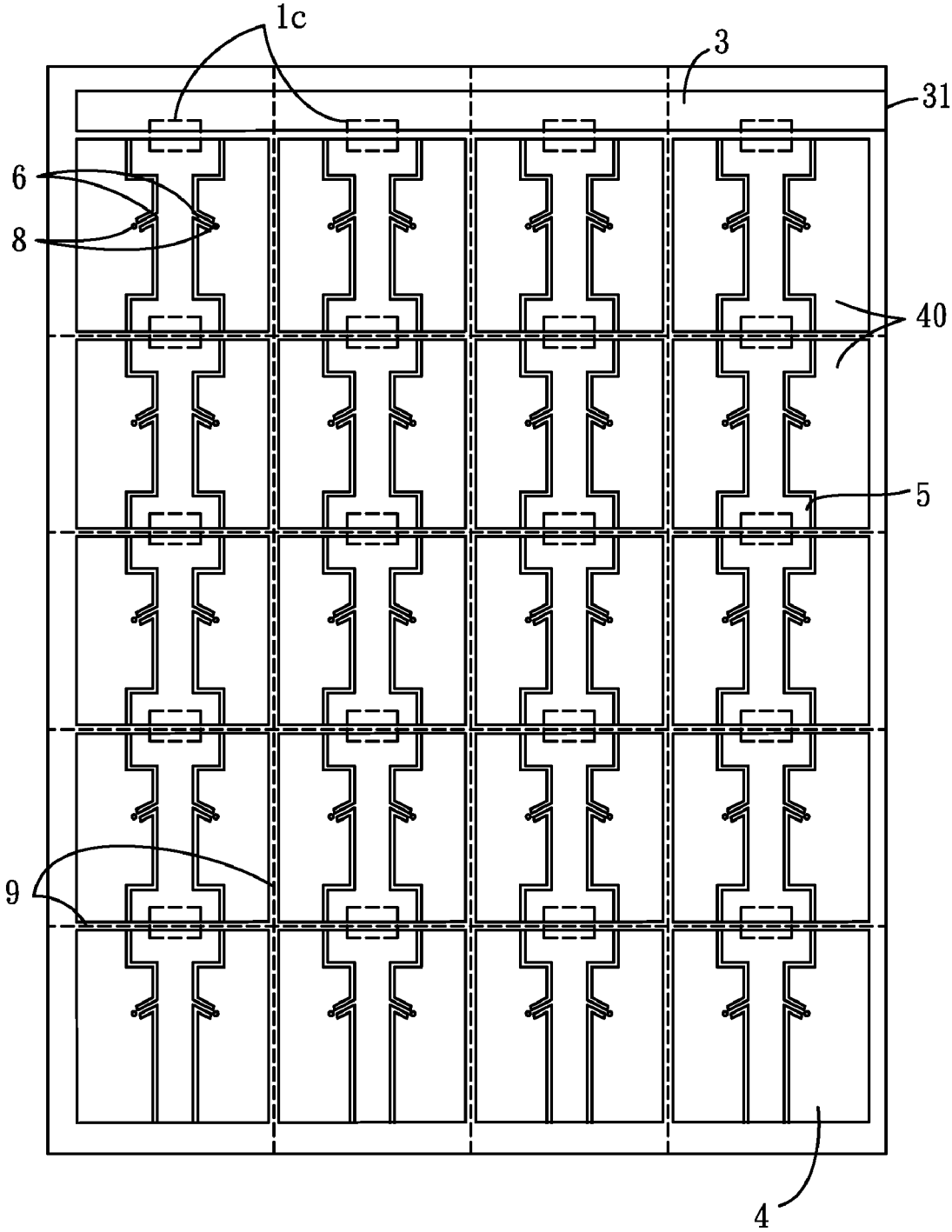
FIG. 9A is a plane view, showing a divisible multi-sectional air enclosure before air filling according to the present invention.
Figure 9B:
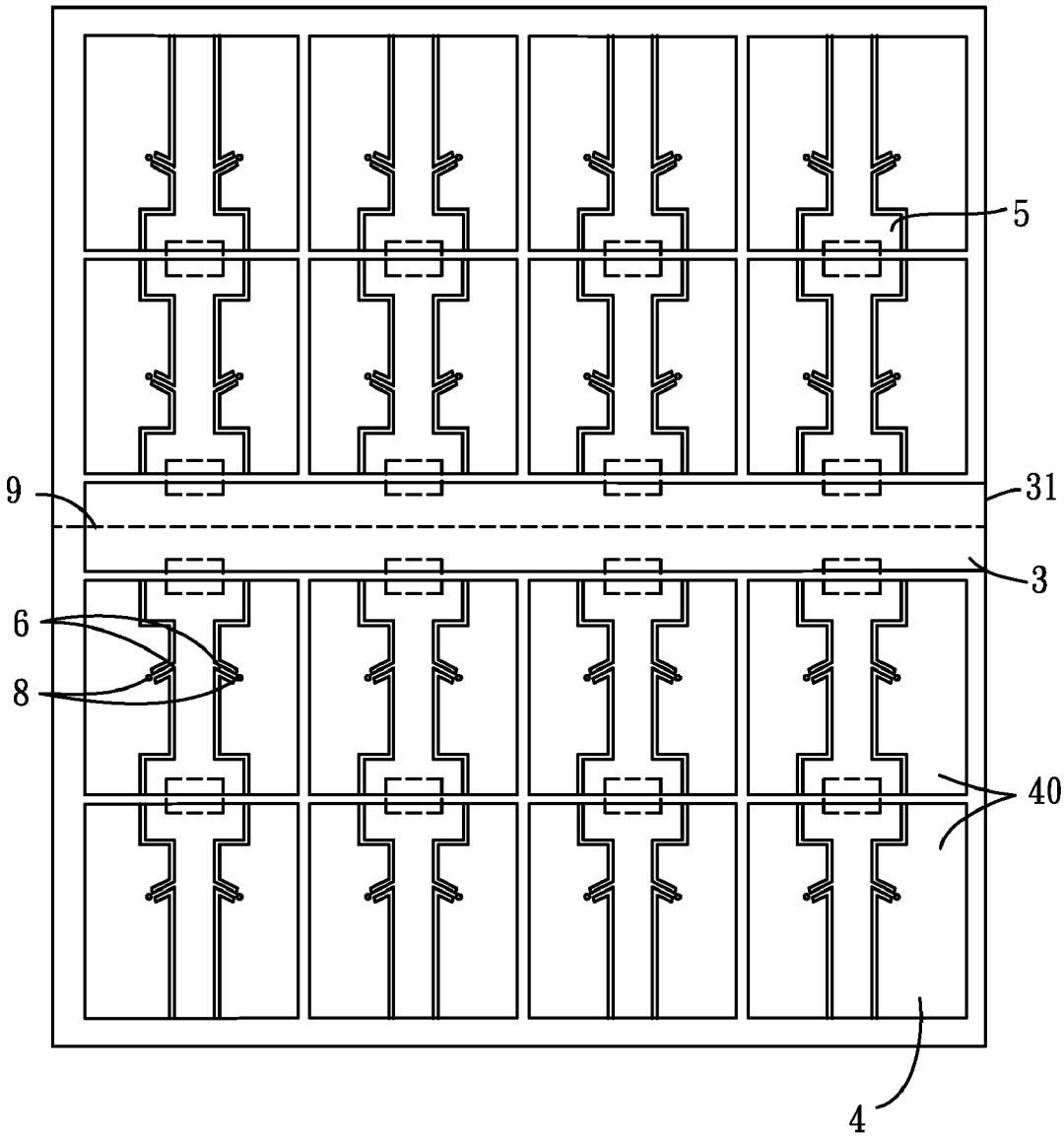
FIG. 9B is a plane view, showing a divisible multi-sectional air enclosure before air filling according to the present invention.

Please refer to FIGS. 9A and 9B. FIG. 9A is a plane view, showing a divisible multi-sectional air enclosure before air filling according to the present invention. FIG. 9B is a plane view, showing another divisible multi-sectional air enclosure before air filling according to the present invention.

Cutting lines 9 are disposed between each two air cylinders 4 and the places that each two chambers 40 are connected in series; cutting along the cutting lines 9 allows each air chamber 40 to be separated. Furthermore, the cutting line can be added on the air filling passageway 3 by line puncturing so as to be convenient for a user to tear the air chambers 40 apart along the cutting line 9 to enable each air chamber 40 to be used independently and the independently utilized air enclosures can be produced on large scale through the disposition of the cutting line 9.

A cutting line 9 can also be disposed on the air filling passageway 3 to allow the air cylinders 4 at the both ends of the air filling passageway 3 to be separated by cutting along the cutting line 9 after the air is filled up; this allows the product output of the air cylinders 4 to be doubled.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A multi-sectional air enclosure, comprising:

two outer films, folded together vertically;

an inner film, disposed between the two outer films and one surface thereof being spread with a heat resistant material;

an air filling passageway, disposed between the two outer films and used for allowing outside air to be filled in;

a plurality of air cylinders, disposed side by side beside the air filling passageway and adhered to form between the two outer films by means of hot sealing, each air cylinder being adhered to form a plurality of air chambers in series by means of hot sealing;

at least one air inlet, formed between the inner film and one of the outer films by not adhering the inner film to another film by means of hot sealing and used for communicating the air filling passageway with the air cylinder;

a plurality of air passageways, connected to the air inlets and formed between the inner film and one of the outer films by not adhering the inner film to another film by means of hot sealing;

a plurality of branch air passageways, communicating with the air passageway and formed between the inner film and one of the outer films by not adhering the inner film to another film by means of hot sealing; and a plurality of openings, positioned on the inner film, each opening being positioned at an end of each branch air passageway;

wherein, outside air in the air filling passageway flows into the plurality of branch air passageways via the air passageway and is filled into each air chamber via each opening to allow the air chamber to be filled with air and inflated, and the air in the air chamber thrusts the air passageway to cause the air to be locked.

2. The air enclosure according to claim 1, wherein the dimensions of the outer film and the inner film are the same.

3. The air enclosure according to claim 1, wherein the length of the inner film is shorter than the outer film, an upper side of the inner film is lined up with a upper side of the outer film.

4. The air enclosure according to claim 1, wherein the air filling passageway is formed by allowing the inner film to be adhered to the outer film or the two outer films by means of hot sealing.

5. The air enclosure according to claim 1, further comprising at least one cuffing line positioned between the plurality of air cylinders, on the place that the air chambers are connected in series, on the air filling passageway or on the combination thereof.

6. A multi-sectional air enclosure, comprising:

two outer films, folded together vertically;

two inner films, disposed between the two outer films and a heat resistant material being spread between the two inner films;

an air filling passageway, disposed between the two outer films and used for allowing outside air to be filled in;

a plurality of air cylinders, disposed side by side beside the air filling passageway and adhered to form between the two outer films by means of hot sealing, each air cylinder being adhered to form a plurality of air chambers in series by means of hot sealing;

at least one air inlet, formed between the two inner film by adhering the two inner films to each other by means of hot sealing and used for communicating the air filling passageway with the air cylinder;

a plurality of air passageways, connected to the air inlets and formed between the two inner films by adhering the two inner film to each other by means of hot sealing;

a plurality of branch air passageways, communicating with the air passageway and formed between the two inner films by adhering the two inner films to each other by means of hot sealing; and a plurality of openings, positioned on the inner film, each opening being positioned at an end of each branch air passageway;

wherein, outside air in the air filling passageway flows into the plurality of branch air passageways via the air passageway and is filled into each air chamber via each the opening to allow the air chamber to be filled with air and inflated, and the air in the air chamber thrusts the air passageway to cause the air to be locked.

7. The air enclosure according to claim 6, wherein the dimensions of the outer film and the inner film are the same.

8. The air enclosure according to claim 6, wherein the length of the inner film is shorter than the outer film, a upper side of the inner film is lined up with a upper side of the outer film.

9. The air enclosure according to claim 6, wherein the air filling passageway is formed by allowing the inner film to be adhered to the outer film, the two outer films or the two inner films by means of hot sealing.

10. The air enclosure according to claim 6, wherein the plurality of openings are positioned on the inner film or the two inner films.

11. The air enclosure according to claim 6, further comprising at least one cutting line positioned between the plurality of air cylinders, on the place that the air chambers are connected in series, on the air filling passageway or on the combination thereof.

12. A check valve apparatus of a multi-sectional air enclosure, assembled in a plurality of air cylinders formed by adhering two outer films to each other by means of hot sealing, and each air cylinder being formed into a plurality of air chambers in series by means of hot sealing, the check valve apparatus comprising:

an inner film, disposed between the two outer films, and one surface of the inner film being spread with a heat resistant material;

an air passageway, formed between the inner film and one of the two outer films by not adhering the inner film to another film by means of hot sealing;

a plurality of branch air passageway, communicating with the air passageway and formed between the inner film and one of the two outer films by not adhering the inner film to another film by means of hot sealing; and a plurality of openings, positioned on the inner film, each the opening being positioned at an end of each branch air passageway;

wherein, outside air flows into the plurality of branch air passageways via the air passageway and is filled into each air chamber via each opening to allow the air chamber to be filled with air and inflated, and the air in the air chamber thrusts the air passageway to cause the air to be locked.

13. The check valve apparatus according to claim 12, wherein the dimensions of the outer film and the inner film are the same.

14. The check valve apparatus according to claim 12, wherein the length of the inner film is shorter than the outer film, a upper side of the inner film is lined up with a upper side of the outer film.

15. A check valve apparatus of a multi-sectional air enclosure, assembled in a plurality of air cylinders formed by adhering two outer films to each other by means of hot sealing, and each air cylinder being formed into a plurality of air chambers in series by means of hot sealing, the check valve apparatus comprising:

two inner films, disposed between the two outer films, and a heat resistant material being spread between the two inner films;

an air passageway, formed between the two inner films by adhering the two inner films to each other by means of hot sealing;

a plurality of branch air passageway, communicating with the air passageway and formed between the two inner films by adhering the two inner films to each other by means of hot sealing; and a plurality of openings, positioned on the inner film, each opening being positioned at an end of each branch air passageway;

wherein, outside air flows into the plurality of branch air passageways via the air passageway and is filled into each air chamber via each opening to allow the air chamber to be filled with air and inflated, and the air in the air chamber thrusts the air passageway to cause the air to be locked.

16. The check valve apparatus according to claim 15, wherein the dimensions of the outer film and the inner film are the same.

17. The check valve apparatus according to claim 15, wherein the length of the inner film is shorter than the outer film, a upper side of the inner film is lined up with a upper side of the outer film.

18. The check valve apparatus according to claim 15, wherein the two inner films are compressed by the air in the air chamber to attach closely onto one of the outer films.

19. The check valve apparatus according to claim 15, wherein the two inner films are compressed by the air in the air chamber.

20. The check valve apparatus according to claim 15, wherein the plurality of openings are positioned on one of the two inner films or both of the two inner films.

* * * * *